US006278914B1

(12) United States Patent
Gaudreau et al.

(10) Patent No.: US 6,278,914 B1
(45) Date of Patent: Aug. 21, 2001

(54) ADAPTIVE SIGNAL CONDITIONING DEVICE FOR TRAIN TILTING CONTROL SYSTEMS

(75) Inventors: Daniel Gaudreau, St-Bruno-de-Montarville; Tho Le-Ngoc, Ville d'Anjou, both of (CA)

(73) Assignee: Bombardier Inc., Montreal (CA)

( * ) Notice: Subject to any disclaimer, the term of this patent is extended or adjusted under 35 U.S.C. 154(b) by 0 days.

(21) Appl. No.: 09/383,968

(22) Filed: Aug. 26, 1999

(51) Int. Cl.[7] ..... B61B 12/02
(52) U.S. Cl. ..... 701/19; 701/72; 105/199.2
(58) Field of Search ..... 701/19, 37, 48, 701/72, 124, 220; 105/80, 261.1, 199.2

(56) References Cited

U.S. PATENT DOCUMENTS

| | | | | |
|---|---|---|---|---|
| 3,572,747 | | 3/1971 | Pollinger et al. . | |
| 3,683,818 | | 8/1972 | Meir et al. . | |
| 3,789,769 | | 2/1974 | Strohmer et al. . | |
| 3,844,225 | | 10/1974 | Di Majo . | |
| 3,970,009 | | 7/1976 | Schultz . | |
| 4,267,736 | | 5/1981 | Westbeck . | |
| 4,440,093 | * | 4/1984 | Kakehi et al. | 105/164 |
| 4,464,721 | * | 8/1984 | McKenna | 701/220 |
| 4,715,289 | | 12/1987 | Okamoto et al. . | |
| 5,103,396 | | 4/1992 | Hiwatashi et al. . | |
| 5,170,716 | | 12/1992 | Durand et al. . | |
| 5,285,729 | | 2/1994 | Bangstsson et al. . | |
| 5,295,443 | | 3/1994 | Bangstsson et al. . | |
| 5,331,903 | | 7/1994 | Elia . | |
| 5,346,242 | | 9/1994 | Karnopp . | |
| 5,430,647 | | 7/1995 | Raad et al. . | |
| 5,809,448 | | 9/1998 | Gimenez et al. . | |

FOREIGN PATENT DOCUMENTS

| | | |
|---|---|---|
| 049 957 | 1/1966 | (DE) . |
| 1933893 | 2/1970 | (DE) . |
| 0 557893 | 11/1996 | (EP) . |
| 0 808758 | 11/1997 | (EP) . |

OTHER PUBLICATIONS

Introduction—Railway Technology International, by Geoffrey Freeman Allen, Oct., 1985, pp. 7–8.
The Swing Active Body Tilt System—Railway Technology International, Oct., 1995, pp. 61–62.
The Active Tilting–System SIG–Swing, SIG Brochure.
All Aboard for High–Speed Rail—Mechanical Engineering, Sep. 1996, by David Herman, pp. 94–97.
Le Difficile Avenement Du <<Cisalpino>>—Rail Passion, N Jul. 10, 1996, by Philippe Herisse, pp. 46–48.
Quatre Pistes Pour L'Apres Grande Vitesse, La vie du Rail & des transports, N 2541, Apr. 10, 1996, by Dumont, Francois et. Al., pp. 14–18.
A Bord Du Noiveau Train Pendulaire Italien, La vie du Rail & des transports, N 2539, Mar. 27, 1996, p. 11.
Talbot Tilt System Prepares for Trials, Passenger Rail, Dec. 1995/Jan. 1996, pp. 35, 39–42.
Fiat Dominates Tilting Train Market, International Railway Journal, Dec. 1995, pp. 22–23.
New Tilting Mechanisms Developed, International Railway Journal, Dec. 1995, pp. 26–27.

(List continued on next page.)

*Primary Examiner*—William A. Cuchlinski, Jr.
*Assistant Examiner*—Arthur D. Donnelly
(74) *Attorney, Agent, or Firm*—Pillsbury Winthrop LLP

(57) ABSTRACT

The described device uses the signal from an inertial force sensor as input and produces a filtered output with minimal delay. The filtering level is determined by the device, according to a function of the input signal observation and a pre-defined desired signal criteria. The output signal produced by the device is suitable to be used as a control signal for the operation of a tilting railway vehicle. One or more of such device can be used concurrently to obtain filtered signals from various inertial sensors.

18 Claims, 11 Drawing Sheets

OTHER PUBLICATIONS

Perserverance Brings Commerical Reward, International Railway Journal, Dec. 1992, pp. 23, 25, 28.
The Development of Advanced High Speed Vehicles in Sweden, Proc. Instn. Mech. Engrs., vol. 198D, No. 15, 1984, by E. Andersson et al., pp. 229–37.
Swedish Body–Tilting Electric Set for Very High Speed on Severly–Cured Main–Lines, Rail Engineering International, May/Sep. 1982.
Computers Take Over on X2, Railway Gazette International, Jul. 1987, by Lennart Sandberg, pp. 447–49.
Further Developments with the Italian Solution on Tilting Trains, World Congress on Railway Research Conference 1996, by C. Casini et al., pp. 371–80.
Bischheim: Le TGV Pendulaire Pret Pour les Essais, La vie du Rail & des transports, N. 2631, Jan. 28, 1998, by Lain Wairt, p. 10.
Tilting Trains: How Do They Work?, The Railway Magazine, Aug. 1997, pp. 56–61.
QR to Start Service in 1998, International Railway Journal, Aug. 1997, pp. 15–16.
Tilt System for Amtrak High Speed Trainsets, IEEE/ASME Conference, Mar. 18–20, 1997 by Helmut Kolig et al., pp. 59–64.
Axis: Quand La RTG Devient Pendulaire, La vie du Rail & des transports, Jun. 3, 1998, by Alain Wairt, p. 6.
Axis: Le Demonstrateur Pendulaire de Bombardier, Revue Generale des Chemins de Fer, Jan. 1999, pp. 57–58.
Bullet Train for America—Popular Mechanic, Mar. 1993, by Gregory T. Pope,ppinted on Nov. 23, 1999 from web site at www.popularmechanics.com/popmech/sci/9303STT RAM.html.
American Flyer—Popular Mechanics, Nov. 1996, by Jim Wilson, printed on Nov. 23, 1999 from web site at www.popularmechanics.com/popmech/sci/9611STTRBM.html.
Bombardier's New Generation Tilting System—IEEE Canadian Review, Spring/Summer 1995—pp. 11–14.
French Start Tests With New Tilting TGV Bogie, International Railway Journal, Bogie & Wheelset Technology, Jul. 1999, pp. 25–26.

* cited by examiner

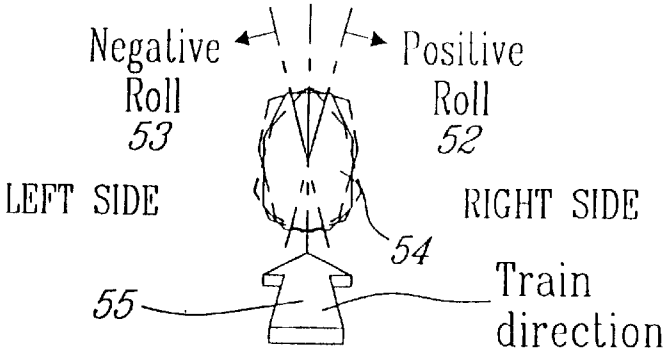
FIG. 3
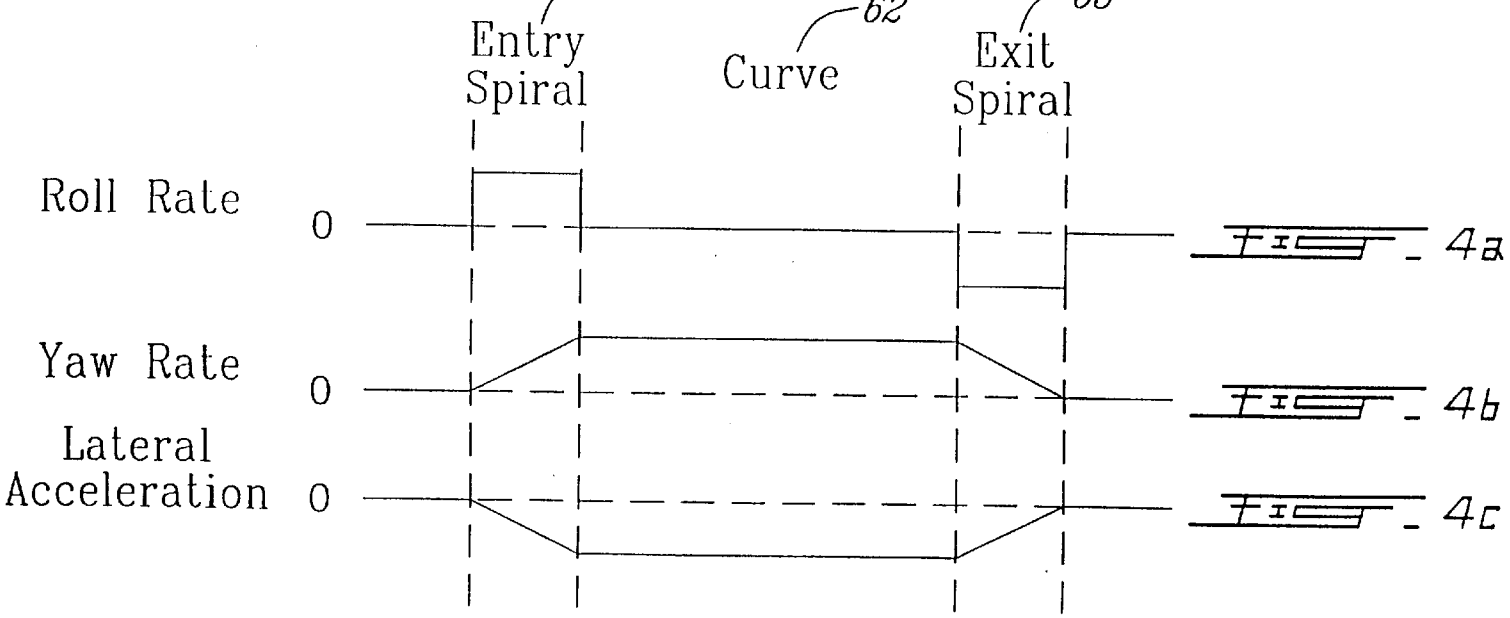

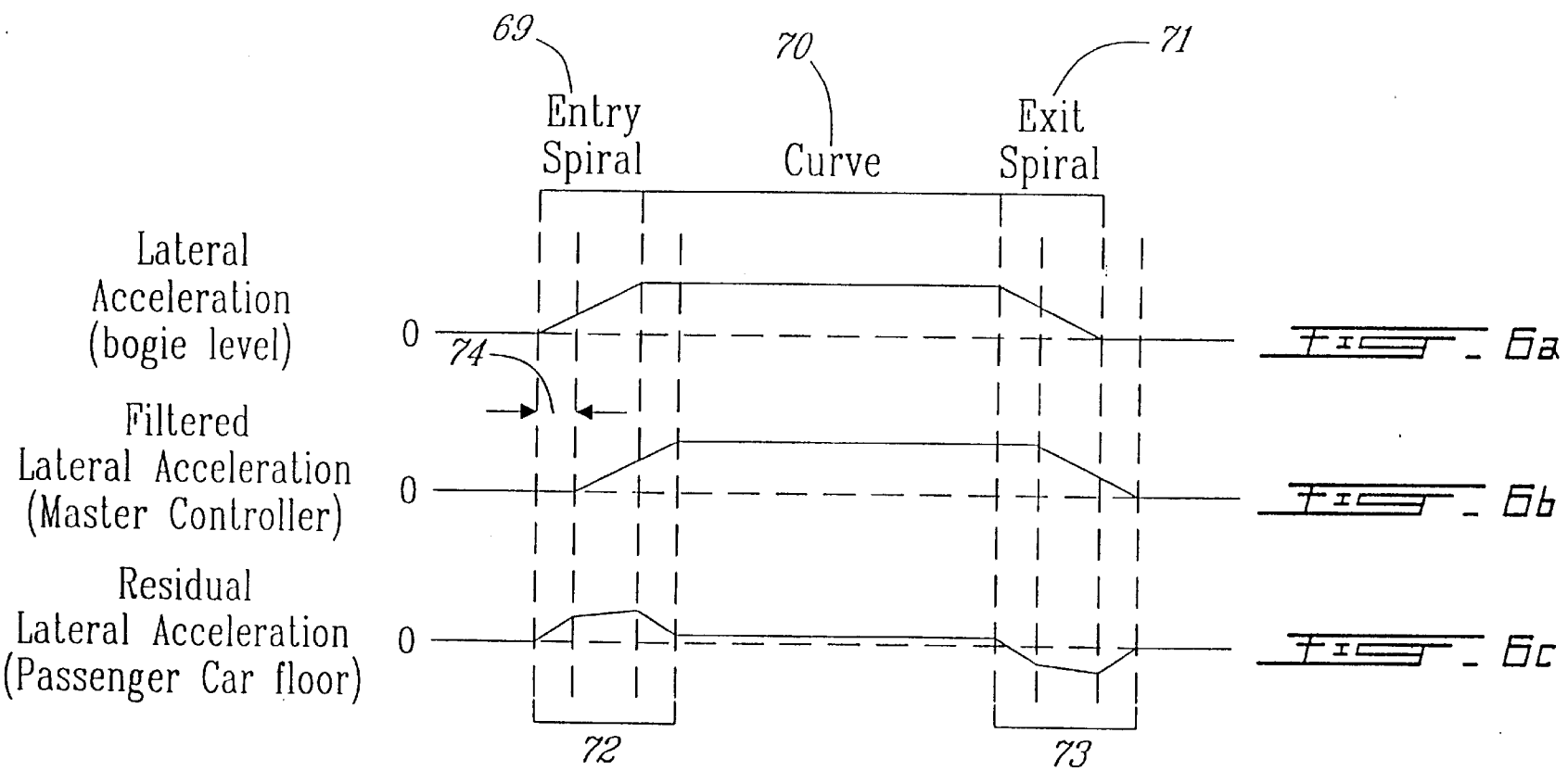
Lateral Acceleration (bogie level)
Filtered Lateral Acceleration (Master Controller)
Residual Lateral Acceleration (Passenger Car floor)
0
0
0
Entry Spiral
Curve
Exit Spiral
69
70
71
72
73
74
6a
6b
6c

ADAPTIVE SIGNAL CONDITIONING DEVICE FOR TRAIN TILTING CONTROL SYSTEMS

FIELD OF THE INVENTION

The invention relates to tilting systems used in railway vehicles to control longitudinal roll motion mechanisms in order to increase passenger comfort. In particular, with an inertial force sensor as input, the invention produces a filtered output for a tilting control system with minimal delay.

BACKGROUND OF THE INVENTION

It is becoming necessary to rethink the actual train infrastructure: travel time must be reduced to compete with airlines, existing tracks must be shared with freight trains, and land or budget constraints often prohibit the construction of dedicated high-speed tracks. The only solution is tilt technology. The need for tilting control systems was discussed in the November 1996 issue of *Popular Mechanics* magazine, in an article entitled "American Flyer", as being a solution to improve passenger comfort during train rides. As stated in the magazine, advanced tilting systems could reduce the lateral force felt at the passenger level from 15 lbs. to 7 lbs.

A "tilting system" is a combination of electronic and hydraulic components that control a railway car's longitudinal roll motion mechanism. It is used in passenger trains in order to increase passenger comfort, that is affected by centrifugal acceleration in curves. Centrifugal acceleration is a serious limiting factor to the maximum cruising speed of a passenger train.

The maximum speed allowed in curves is limited by three factors: the maximum tilt angle of the car (usually between 5° and 9°), the maximum steady state residual lateral acceleration and the forces applied to the tracks by the non-tilting locomotive, which is almost two times heavier than a passenger car. The dynamic wheel/rail forces are identical for both a tilting and a non-tilting car at a given speed. All forces vary with the square of the speed.

Railroad curves are generally designed in order to compensate for a proportion of the centrifugal acceleration by means of track super-elevation (or cant angle) that will force the car body to tilt along its roll axis. Properly oriented, this tilt angle creates a gravitational component vector opposite to the centrifugal force felt by the passengers in curves. The super-elevation angle of a track is always determined according to the maximal forces that the inner rail can tolerate when the heaviest vehicle allowed to roll on the said track is immobilized in the curve. On conventional tracks, the presence of heavy freight trains is the source of limitation for the maximal super-elevation.

Considering this design criteria, one can demonstrate that most passenger railway corridors in North America and Europe presently lack the proper amount of curve super-elevation that would allow the operation of high-speed trains without seriously compromising passenger comfort. Since modifications to conventional tracks are too costly and since speed and passenger comfort are the key to the survival of the passenger train industry, the solution resides in tilting systems.

Passenger cars equipped with an active roll motion mechanism, also called a "tilting system" can overcome this cant deficiency problem by giving the proper amount of roll to the car body in order to compensate for the lack of curve super-elevation. Passenger comfort is then improved and high-speed operation becomes possible on most of existing railway corridors.

Tilting the body of a rail passenger car during curve negotiation offers the possibility of increasing the speed of a trainset in a curve without exceeding the maximum allowed steady state lateral acceleration felt by the passengers. Typically, the centrifugal acceleration must be lower than 1 m/sec$^2$ (i.e. lower than 0.1 g). This tilting feature reduces the overall traveling time without requiring track modification. Moreover, an effective tilting system greatly improves the passenger ride comfort during curve entry and exit by minimizing the transient accelerations.

Usually, the tilting mechanism only cancels 70% of the centrifugal force. A March 1993 article in *Popular Mechanics* magazine entitled "Bullet Train for America" explains the effect of the tilting system on the passenger: "Standing up, a rider notices the floor push gently against the left foot, as the view out the window pitches skyward". The reason why the centrifugal acceleration is not compensated 100% is because neural signals from the eye would clash with those from the inner ear of the passengers, which senses no change at all, and would cause motion sickness.

The tilting system is activated by the locomotive engineer before the train undertakes a run. A cab indicator informs the engineer of the tilting system status. When the system is activated, the locomotive engineer can operate the train at higher speeds. If the tilting system is deactivated, the train engineer must return to conventional speed in all curves for passenger comfort purposes. The difference between tilting and conventional speeds in high-speed curves is typically 35 km/h.

The main problem associated with taking an input signal from an inertial sensor device located on the train bogie is the high frequency component that will be present because of the contacts with the rails. The train bounces from one side to the other on the tracks, this produces noise in the sensor signal. It is then hard to identify the real inertial signal that is produced when entering or exiting a curve. A filter must then be used to remove the undesirable frequencies from the input signal, otherwise the system behavior would be uncomfortable, by reacting to track defect. In addition, high frequencies in the input signal would shorten the life cycle of costly hydraulic components used in the tilting system by introducing unnecessary demand. The filtering delay is then determined according to the worst conditions found on the tracks where the tilting system will operate. This usually leads to the selection of a long delay filter.

Tilting of the car is accomplished by a servo-valve controlling the hydraulic mechanism, which in turn tilts the car. The tilting control system responds to the output of the long delay filter. The outward acceleration felt by the passengers is compounded by the acceleration of the tilt system, i.e. the outward acceleration due to the curve is added to the inward acceleration due to the compensating tilting. The delay introduced by the filter will lead the passengers to experience a discomfort twice in a curve: at entry and exit. The reaction time of the control system is therefore critical.

The delay in tilt compensation causes lateral acceleration during both curve entry and exit. Each curve represents a potential discomfort source for the passengers. The acceleration due to the tilting of the car is added to lateral acceleration and makes the situation even worse. A possible solution would be to implement costly tilt mechanisms such as the one described in EP patent publication no. 0 808 758 A1, published on May 15, 1997.

OBJECTS OF THE INVENTION

It is the object of the present invention to provide a method which adaptively reduces the delay associated with detecting a curve through an inertial force sensor and sending the adjusted tilting control signal to the tilt controller. The amount of filtering done by the device will be automatically adapted as a function of the input signal quality. A low quality signal requires more filtering thus leading to more delay. A higher quality signal requires less filtering thus leading to less delay. Less delay in the filtering leads to a better synchronization of the tilting control signal(s) with the physical occurrence of dynamics phenomena affecting passenger comfort and that are minimized by a tilting control system.

At the same time, passenger comfort will be increased since early detection and compensation of the lateral acceleration in curves will help control discomforts.

SUMMARY OF THE INVENTION

The present invention is directed to a method that satisfies the need for an early detection of curves and a delay for compensating the lateral acceleration as short as possible.

To generate a tilt control signal using a train inertial sensor signal, according to one broad aspect of the invention, the sensor signal is analyzed to determine at least one filtering parameter. This filtering parameter will be dependent on the noise content of the sensor signal and will ensure a minimum filter delay and an acceptable noise level in the filtered signal. Then, filter characteristics are selected including a filter delay using the filtering parameter previously chosen. Finally, the sensor signal is filtered according to the filter characteristics and the output is a tilt control signal.

Preferably, this method uses digital signal processing. A raw digital signal may be obtained from a sensor device. This signal is filtered with a classic filter giving a desired response. A delayed copy of the original signal is used with the result of the classic filter to determine a set of optimal values for filter coefficients. The number of coefficients is pre-determined: it shall be close to the number of coefficients used in the classic filter. This set of optimal coefficients defines the filter impulse response, which is not symmetrical. The signal from the sensor device is again buffered, this time according to the number of coefficients. Finally, the filter impulse response is convoluted (i.e. digitally filtered) with the buffered signal to produce a tilting control signal. The exploitation of the impulse response asymmetry is a key element of this invention. It can lead to filtering delay reduction, because in the convolution process, the recent raw signal samples are multiplied by coefficients with a higher value than past samples.

BRIEF DESCRIPTION OF THE DRAWINGS

These and other features, aspects and advantages of the present invention will become better understood with regard to the following description and accompanying drawings wherein:

FIG. 3 is a view from the back of a car showing the convention for signal polarity of the roll rate;

FIG. 4 is the ideal dynamic behavior (roll rate, yaw rate and lateral acceleration) of a body traveling on a railway;

FIG. 6 illustrates the consequences of low responsiveness of the system (comprising lateral acceleration, the filtered lateral acceleration and the residual lateral acceleration) where a residual lateral acceleration in curve entry and exit can significantly decrease passenger comfort;

DETAILED DESCRIPTION OF THE PREFERRED EMBODIMENT

Figure 1:
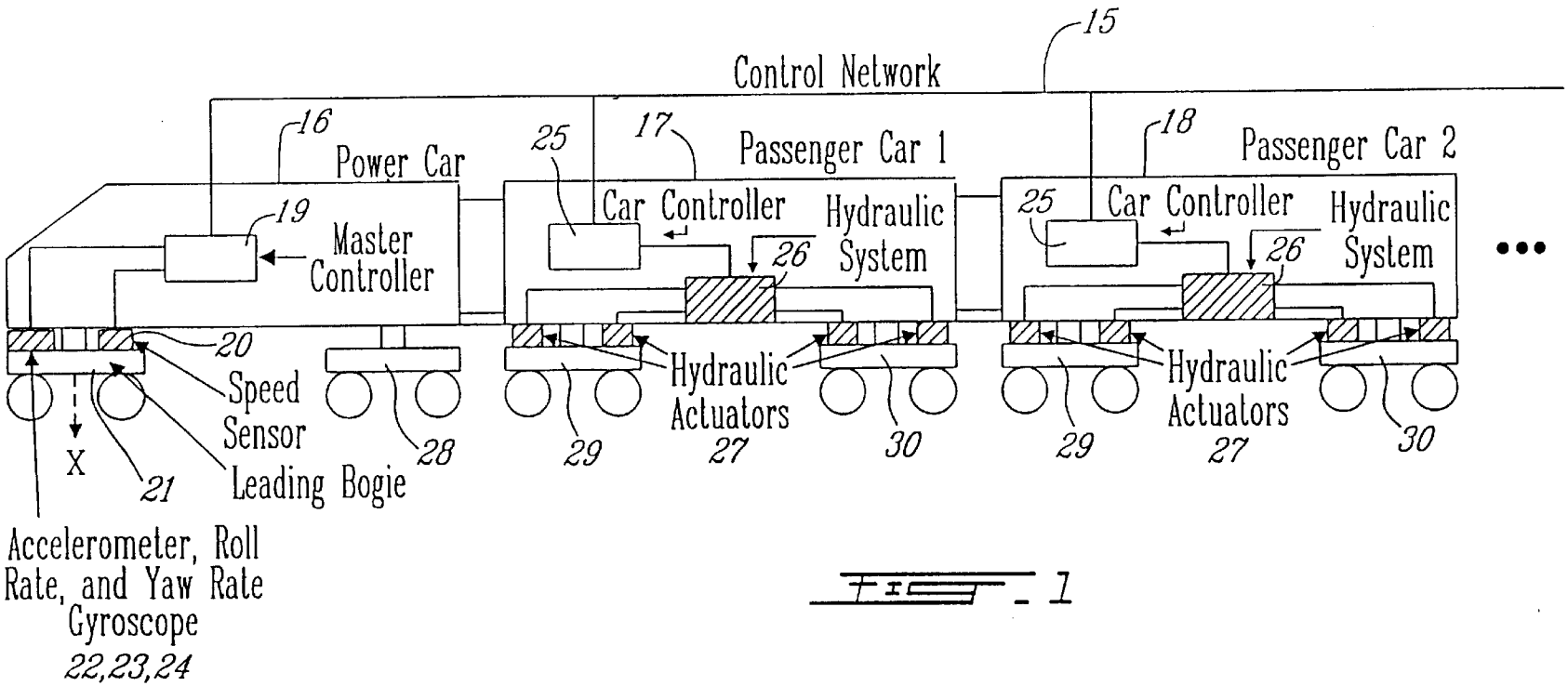
FIG. 1 shows a passenger train comprising a locomotive and two passenger cars and illustrates the main components of the tilting system and their location on a typical trainset.

FIG. 1 illustrates the main components of the tilting system and their location on a typical trainset comprising a power car or locomotive 16, a first passenger car 17, a second passenger car 18 and so on. Speed sensor 20 and inertial sensors such as accelerometer 22, roll rate sensor 23 and yaw rate gyroscope 24 are located on the leading truck 21 of the power car 16 to allow advanced detection of the signals required to operate the system. The master controller 19 receives signals from sensors 20, 22, 23, 24, detects curves and computes appropriate tilting angles for all the passenger cars 17, 18, etc. as a function of speed and car position. Tilting commands are then transmitted to car controllers 25 via the control network 15. The car controllers 25 perform closed-loop control of the hydraulic actuators 27, which give the roll motion to the car body. The actuators 27 can also be of other type, such as electric.

The system architecture also allows the power car 16 to tilt, if the latter is equipped with appropriate components 26 and 27. On other types of tilting system architectures, all the sensing means can be located in each car in the train.

Figure 8:
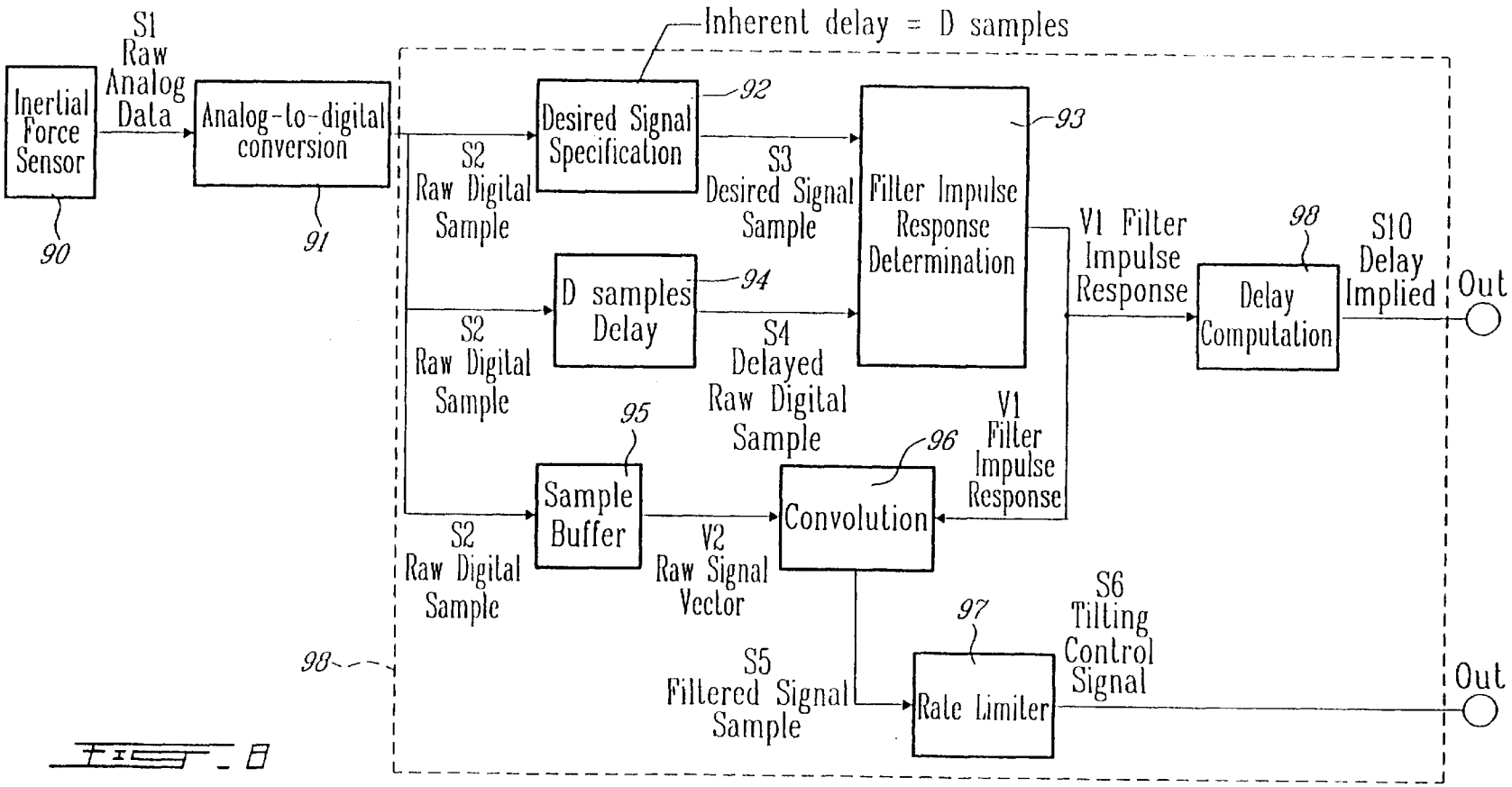
FIG. 8 is a schematic of the signal-conditioning device, contained in the dashed box.

The preferred embodiment, illustrated by FIG. 8, relates to the sensor devices 90 and a signal conditioning component 98 of the master controller of the tilting system, which computes one or more tilting control signal S6, that can be further processed to produce the tilting angle commands from the sensor data and transmits a command to each passenger car 17, 18 via the control network 15.

Figure 2:
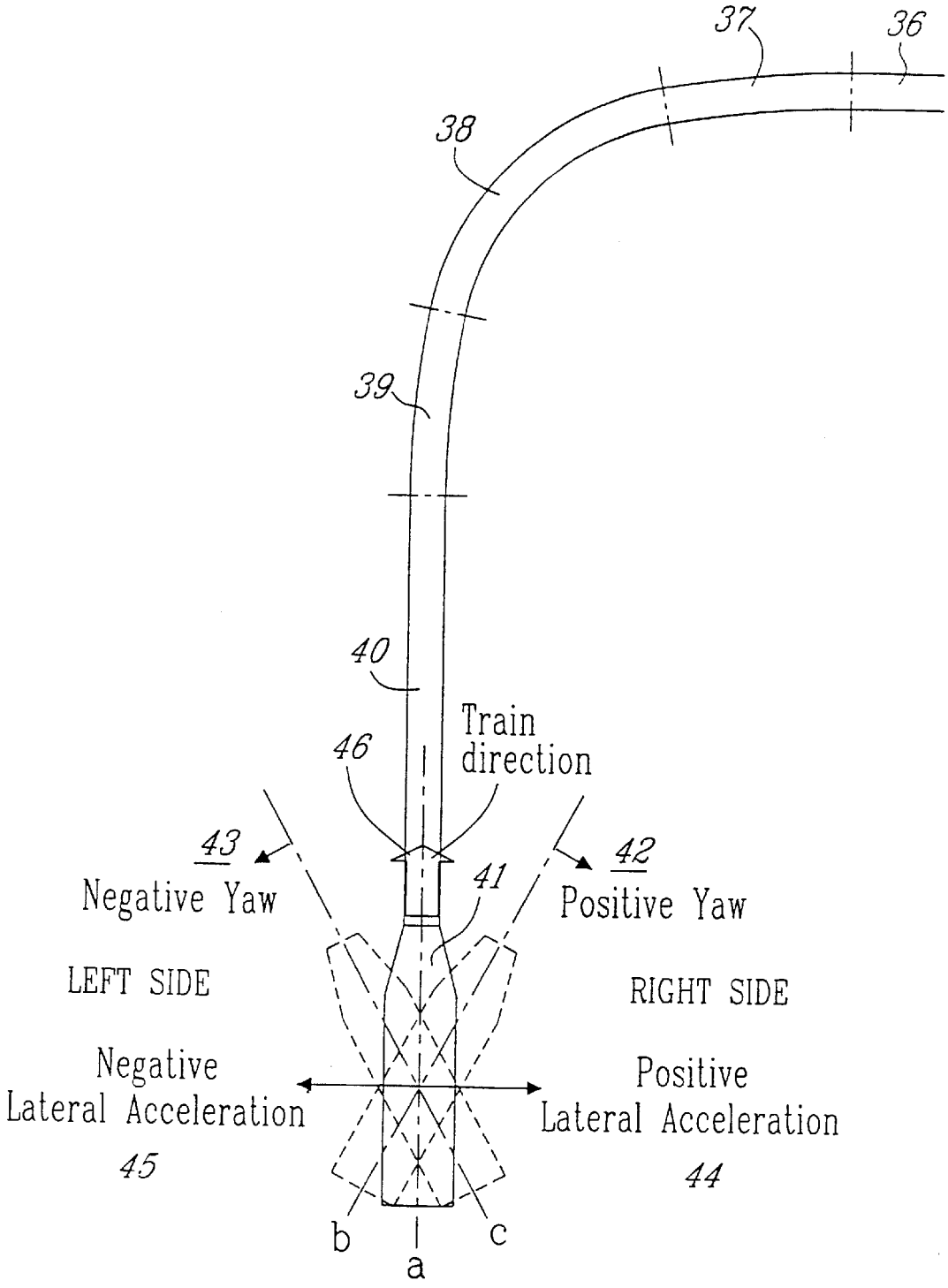
FIG. 2 is an aerial view of a car showing the convention for signal polarity of the yaw rate and the lateral acceleration and showing a typical curve with the entry spiral and the exit spiral.

Change in direction of a railway vehicle is induced by the railroad curvature. FIG. 2 shows a typical curve. All railroads are constructed as a sequence of straight track segments and curves. Passages through curves always involve three steps: entry spiral 39, curve 38 and exit spiral 37. The entry spiral 39 is the transition between straight track segment (infinite radius) 40 and the curve 38 per se, which has a constant radius of curvature. The exit spiral 37 is the transition between the curve 38 and the next straight track segment 36.

Also shown on FIG. 2 and FIG. 3 are the conventions for signal polarity. In FIG. 2*a,* the train 41 follows the tracks in a regular direction 46. In FIGS. 2*b* and 2*c,* the train 41 undergoes a yaw. Also shown in FIG. 2 is the lateral acceleration convention. In FIG. 3, the train 54 is shown going into the page in a typical direction 55; the convention for the roll rate is illustrated.

The ideal dynamic behavior of a body traveling on a railway is described in FIG. 4, where the roll rate (FIG. 4*a*), yaw rate (FIG. 4*b*) and lateral acceleration (FIG. 4*c*) are illustrated. These quantities are measurable by inertial sensors and can be used as inputs to a tilting control system. The effects of entering the entry spiral 61, the curve 62 and the exit spiral 63 are shown.

Figure 5A:
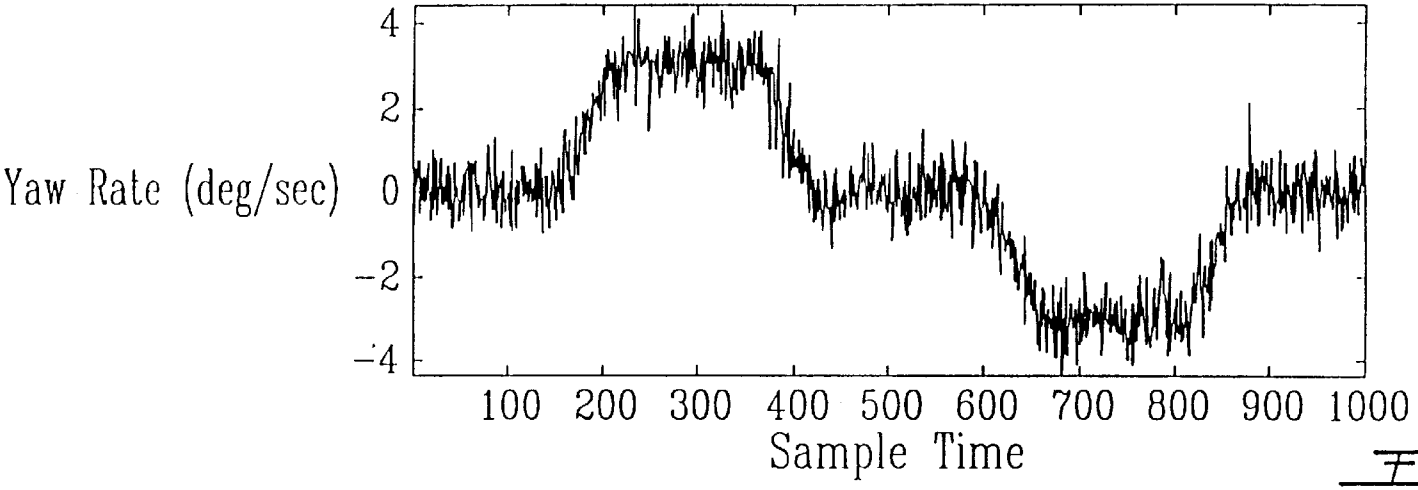
FIG. 5 illustrates typical noisy yaw rate sensor and lateral acceleration signals for two railway curves.
Figure 5B:
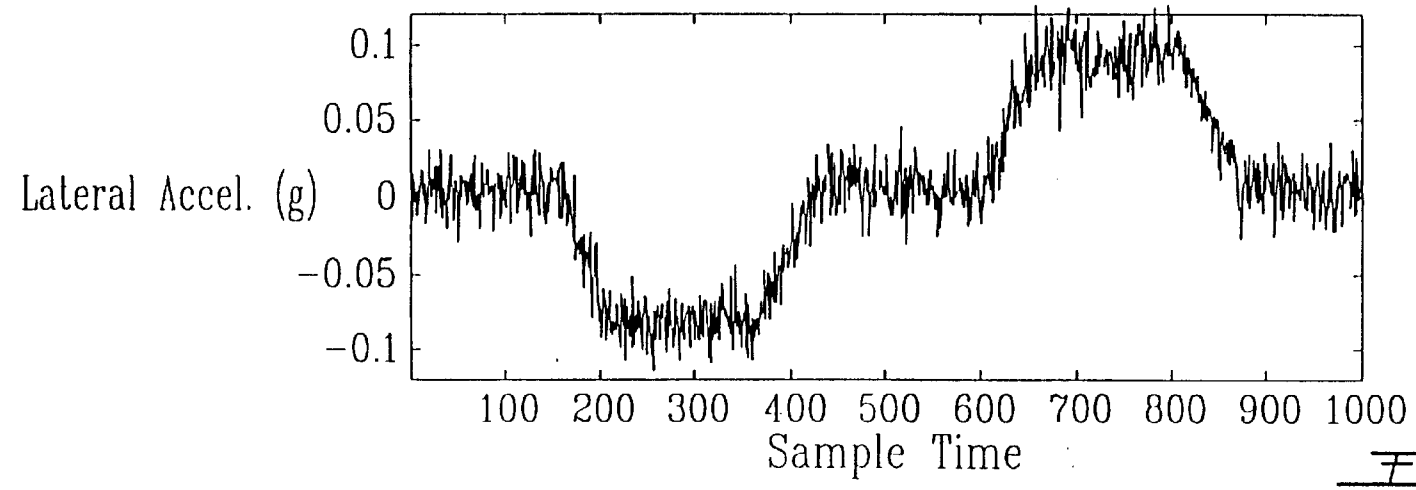

FIG. 5 illustrates typical yaw rate sensor (FIG. 5*a*) and lateral acceleration (FIG. 5*b*) signals for two curves. Noise is present in these signals and has to be filtered out before the signals are used.

The dynamic performance of a tilting system can be measured by its behavior in entry and exit spirals, where lateral acceleration (or cant deficiency) can be rapidly increasing. This responsiveness is strongly affected by the severe level of filtering required for reliable and comfortable system operation. The level of filtering is set based on a "worst case" criteria on signal quality. The consequence of low responsiveness, illustrated in FIG. 6, is the presence of residual lateral acceleration (FIG. 6*c*) in curve entry 69 and exits 71 that can significantly decrease passenger comfort. For sake of simplicity, delays associated to the mechanical components of the actuating system have been neglected, so that the lag 74 is only associated with the raw sensor signal filtering. For reasons associated with passenger perception, the centrifugal acceleration is usually not fully compensated (FIG. 6*c*).

The invention automatically determines the required amount of filtering, thus leading to a minimization of the lag 74 when allowed by signal quality. As a direct consequence, peaks 72 and 73 of FIG. 6*c* are minimized because of a better synchronism between filtered lateral acceleration (FIG. 6*b*) and lateral acceleration (FIG. 6*a*).

Figure 7:
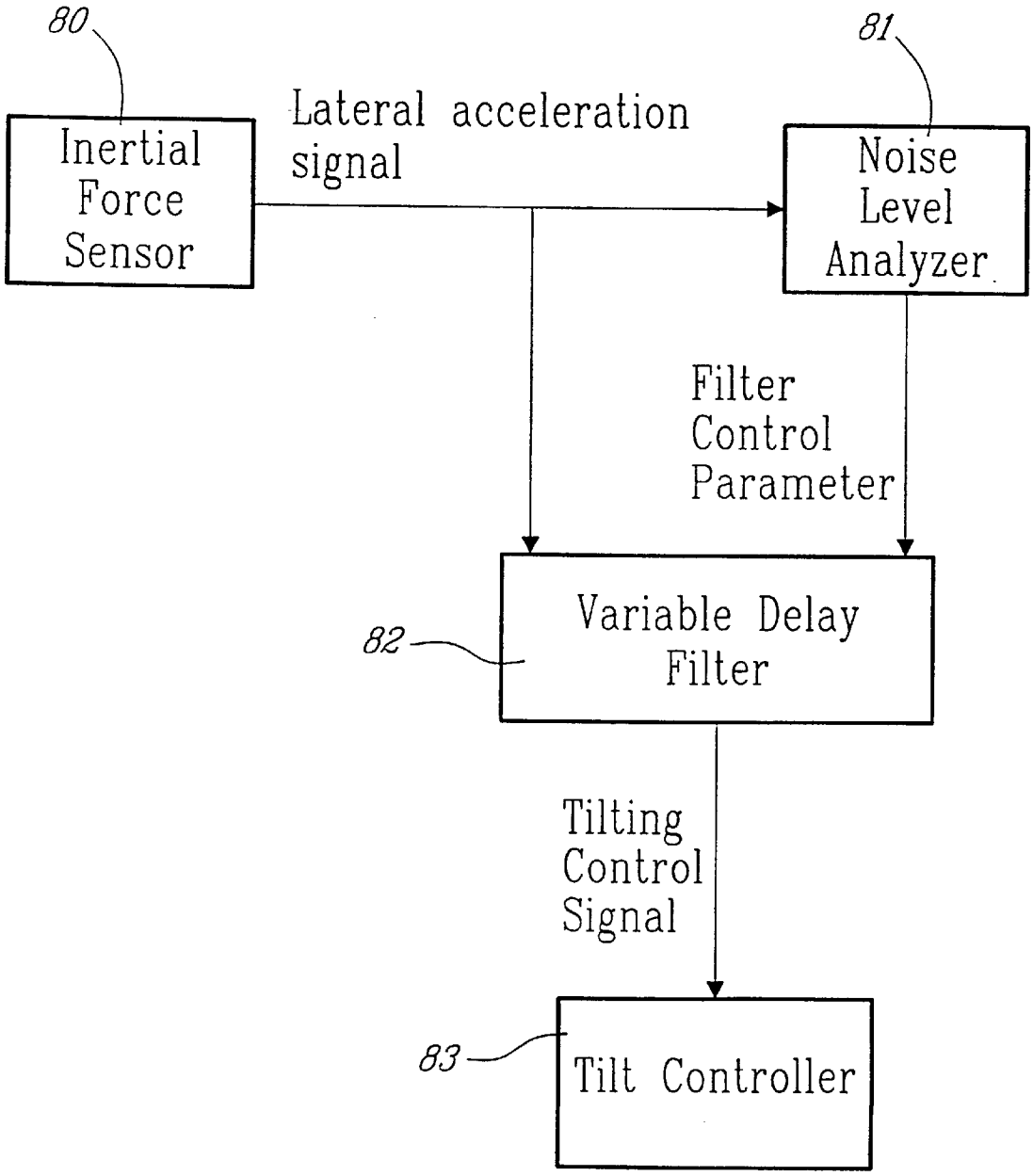
FIG. 7 is a block diagram showing the method of the preferred embodiment from the inertial force sensor to the tilt controller.

FIG. 7 is a schematic representation of a preferred embodiment of the invention. A signal from an inertial force sensor 80 is, for example, a lateral acceleration signal. This signal is fed to a noise level analyzer 81 and to a variable delay filter 82. The noise level analyzer 81 produces a filter control parameter that is also fed to the variable delay filter 82. A tilting control signal is produced from the variable delay filter 82 and fed to the tilt controller 83.

If using analog signal processing, one could analyze the noise content of the analog sensor signal to determine how noisy the signal is and to produce a switch or selector signal. Then, the switch or selector signal will allow choosing the output of the right filter from a series of analog filters, all fed in parallel with the same input signal. These filters would have been designed to correspond to the cases most encountered and would include worst-case filtering as well. The output would be an analog signal. This output could then be digitized to communicate on the control network or kept as an analog signal. This implementation would be less optimal than a digital implementation where the filter control parameter is a vector composed of filter coefficients to be fed into a convolution with the signal.

FIG. 8 presents a schematic of a digital implementation of the signal-conditioning device, contained in the dashed box 98. The inertial force sensor 90 produces an analog output signal S1 that is converted from analog to digital representation by the A/D converter 91. A stream of raw signal samples S2 is thus produced.

At each sampling period, a new raw signal sample S2 is simultaneously given as input to desired signal specification circuit 92, D sample delay 94 and sample buffer 95.

The specification circuit 92 is in fact a conventional low-pass filter from prior art. The filter 92 is preferably a Finite Impulse Response (FIR) filter, with constant group delay. The group delay of a filter is the first derivative of the phase response, times minus 1. A constant group delay means that all frequency components are delayed by the same amount when comparing filter output versus filter input. The cut-off frequency of the filter 92 is set such as to specify the desired signal frequency content. The specification circuit 92 produces a filtered signal S3. The latter signal could be used as a tilting control signal, but since it is filtered with a classic technique, it features a "worst-case design" filter lag (or delay). The latter delay has a fixed value of D samples.

The stream of raw signal samples S2 is also fed to a delaying element 94 that shifts the stream of raw signal samples S2 in time by an amount of D samples, which is equivalent to the inherent delay of the specification circuit 92. The delaying element 94 thus produces a signal sample S4, which is synchronized in time with S3. Signals S3 and S4 are fed to filter impulse response determination circuit 93, which compares the desired and raw signals (S3 and S4) in order to compute the filter impulse response V1 that is required to obtain the frequency content of S3 from S4. The processing performed in 93 is known in the art as Wiener filtering. The filter impulse response V1 is a solution of the Wiener filtering problem.

The filter impulse response V1 determined by the filter impulse response determinator 93 corresponds to a situation located D samples in the past of current sample S2. However, in this case, the raw signal coming in from the inertial force sensor is generally wide sense stationary, which means that the statistical properties of a stream of S2 (the input signal) change only slowly over time. This means that V1 can still be used to filter S2 after a delay of D samples.

Therefore, in order to obtain the tilting control signal, a vector of S2 samples, obtained from stacking up a sequence of S2 samples in the sample buffer 95, is fed to a convolution circuit 96 with the filter impulse response V1 to form an output sample S5. The stream of samples S5 is finally conditioned by a rate-limiting device 97 that will smooth-out possible transient behavior of the filter impulse response determinator 93.

Figure 9:
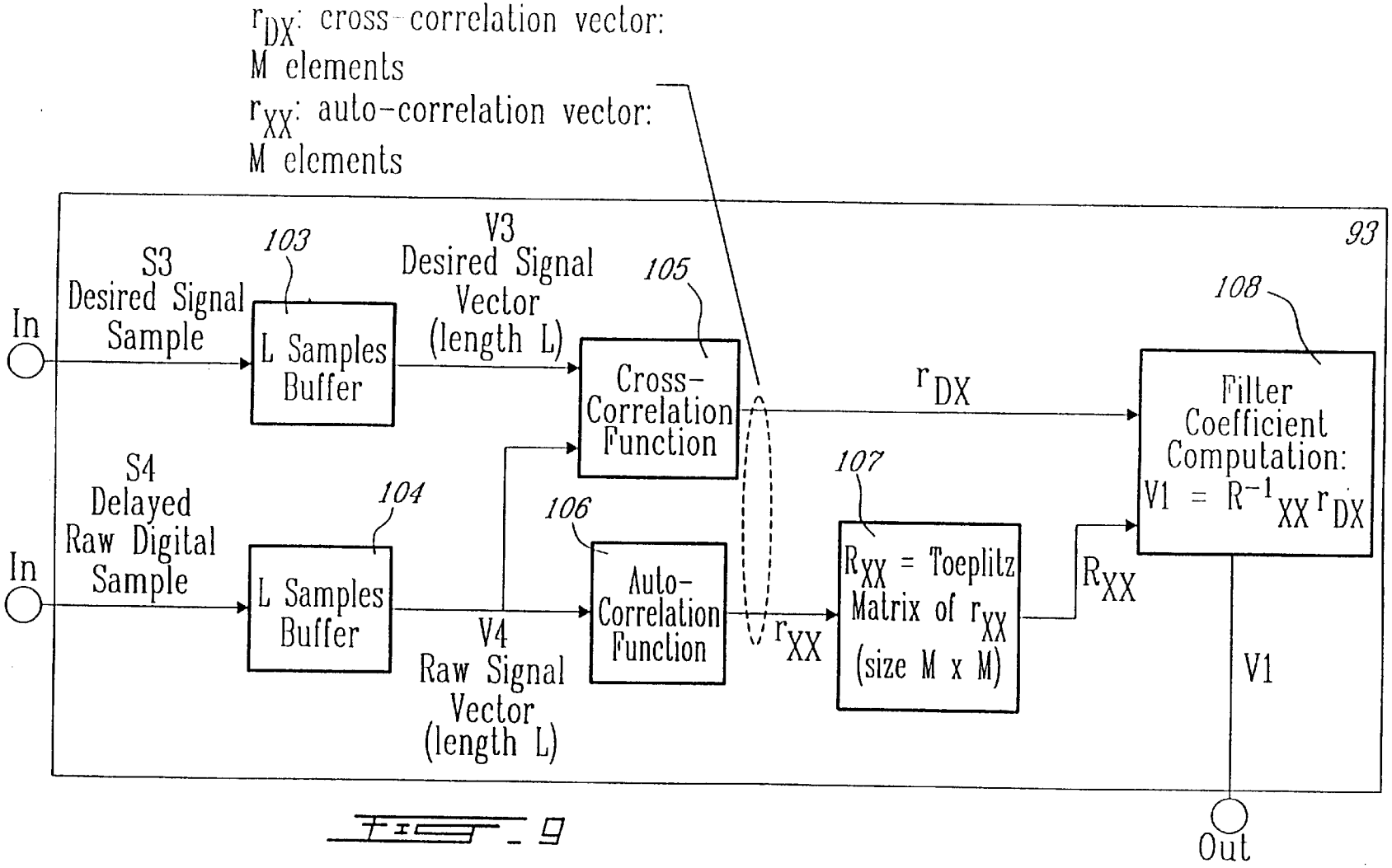
FIG. 9 is a schematic of a method to determine the finite impulse response using a Wiener solution relying on autocorrelation and cross-correlation estimation techniques.
Figure 10:
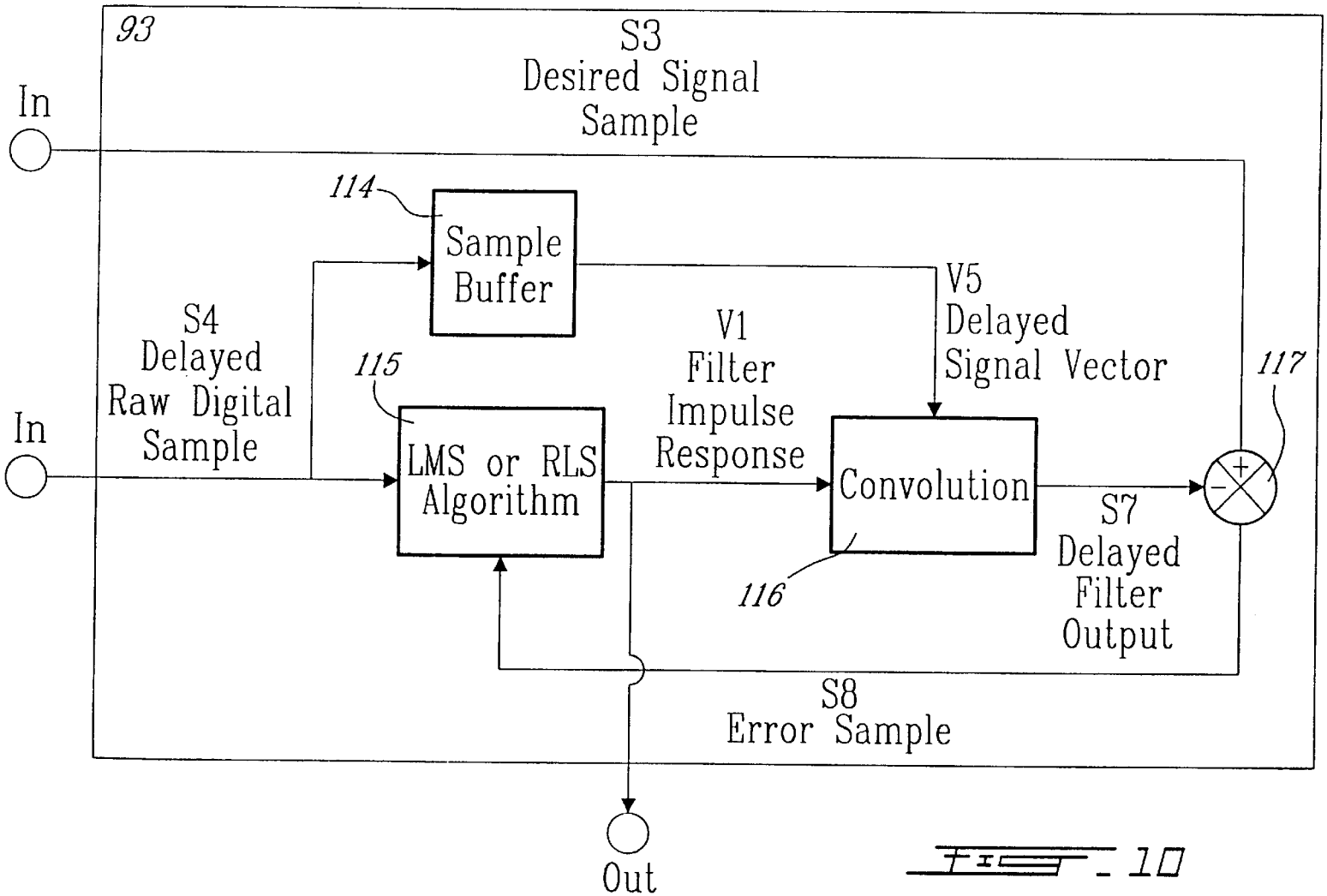
FIG. 10 is another schematic of a method to determine the finite impulse response using Least-Mean Square algorithm.

The Finite Impulse Response Determinator 93 can be implemented as in FIG. 9 or FIG. 10. In both cases, the resulting V1 is a vector of coefficients (or filter weights) of an FIR filter.

In FIG. 9, the Wiener solution is computed from estimates of the auto-correlation matrix and cross-correlation vector. This is performed by accumulating an amount of L samples (L is a quantity of samples that is a function of the sampling frequency and approximately 30 seconds of signal history) of the signals S3 and S4 in buffers 103 and 104 to form desired signal vector V3 and raw signal vector V4. The vector V3 and an instance of V4 is given as input to cross-correlation function 105, which produces vector $r_{dx}$, an estimate of the cross-correlation vector between desired (S3) and raw signals (S4). The auto-correlation function 106 uses V4 to produce $r_{xx}$, an estimation of the auto-correlation vector of the raw signal (S4). The application of the Toeplitz matrix 107 constructs the auto-correlation matrix $R_{xx}$ from auto-correlation vector $r_{xx}$ and filter coefficient computation 108 performs the matrix inversion of $R_{xx}$ and multiplies the result by vector $r_{dx}$ to obtain the Wiener solution estimate, which is used as the filter impulse response V1.

In FIG. 10, the Wiener solution is approximated by a technique that requires less memory and computing resources. A Least-Mean Square (LMS) or Recursive Least Square (RLS) algorithm 115, converges (over time) towards the Wiener solution, as a function of the Delayed Raw Digital Sample stream S4 and error sample stream S8, given as inputs. The error sample stream S8 is the result of subtracting the result of the convolution S7 to the desired signal sample S3. Signal S7 is produced by the convolution of the delayed signal vector V5 with filter impulse response V1.

Figure 11:
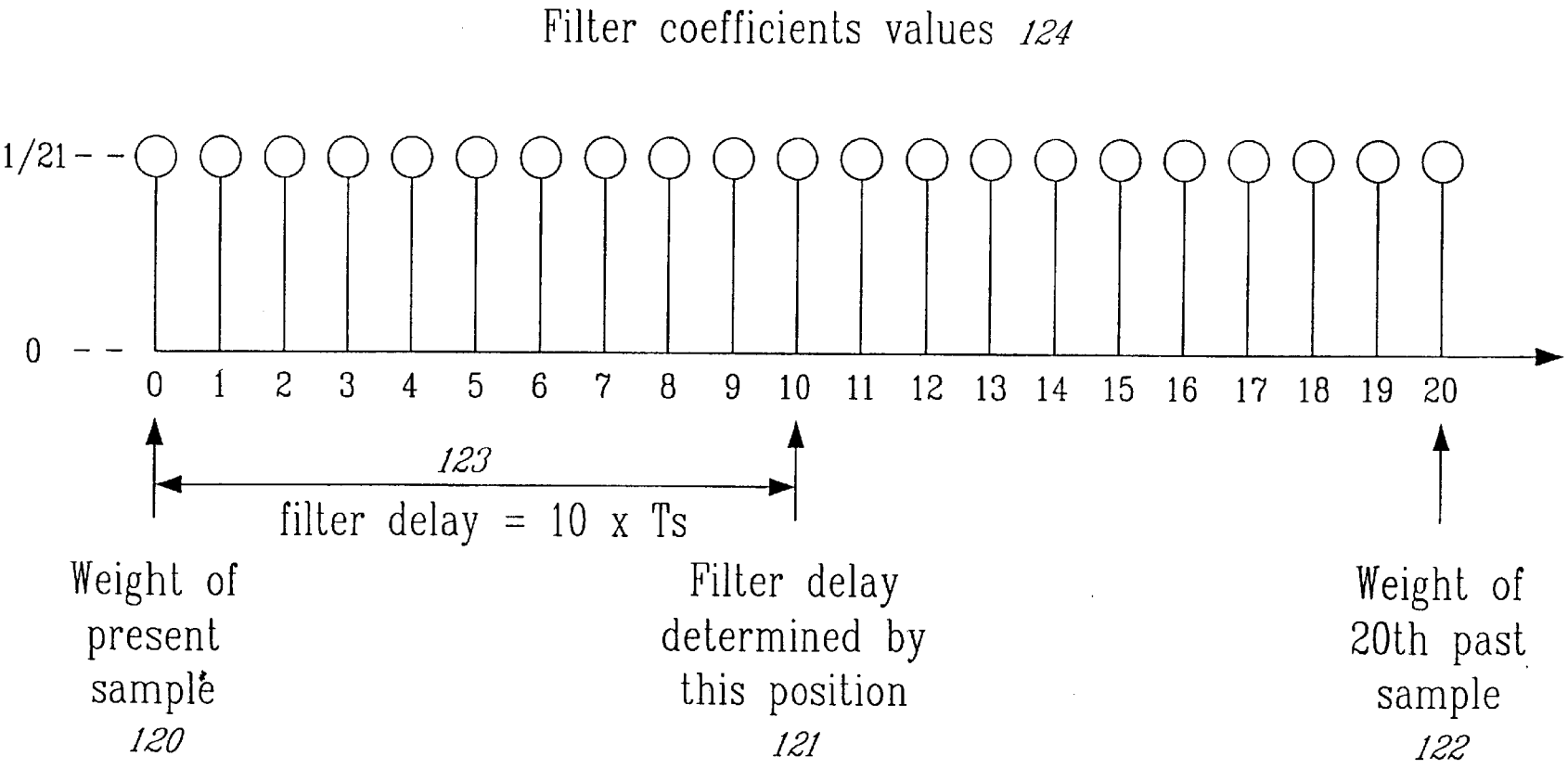
FIG. 11 is a schematic that illustrates the tendency of the filter coefficients to have a uniform value when the desired signal is difficult to extract from the raw signal.
Figure 12:
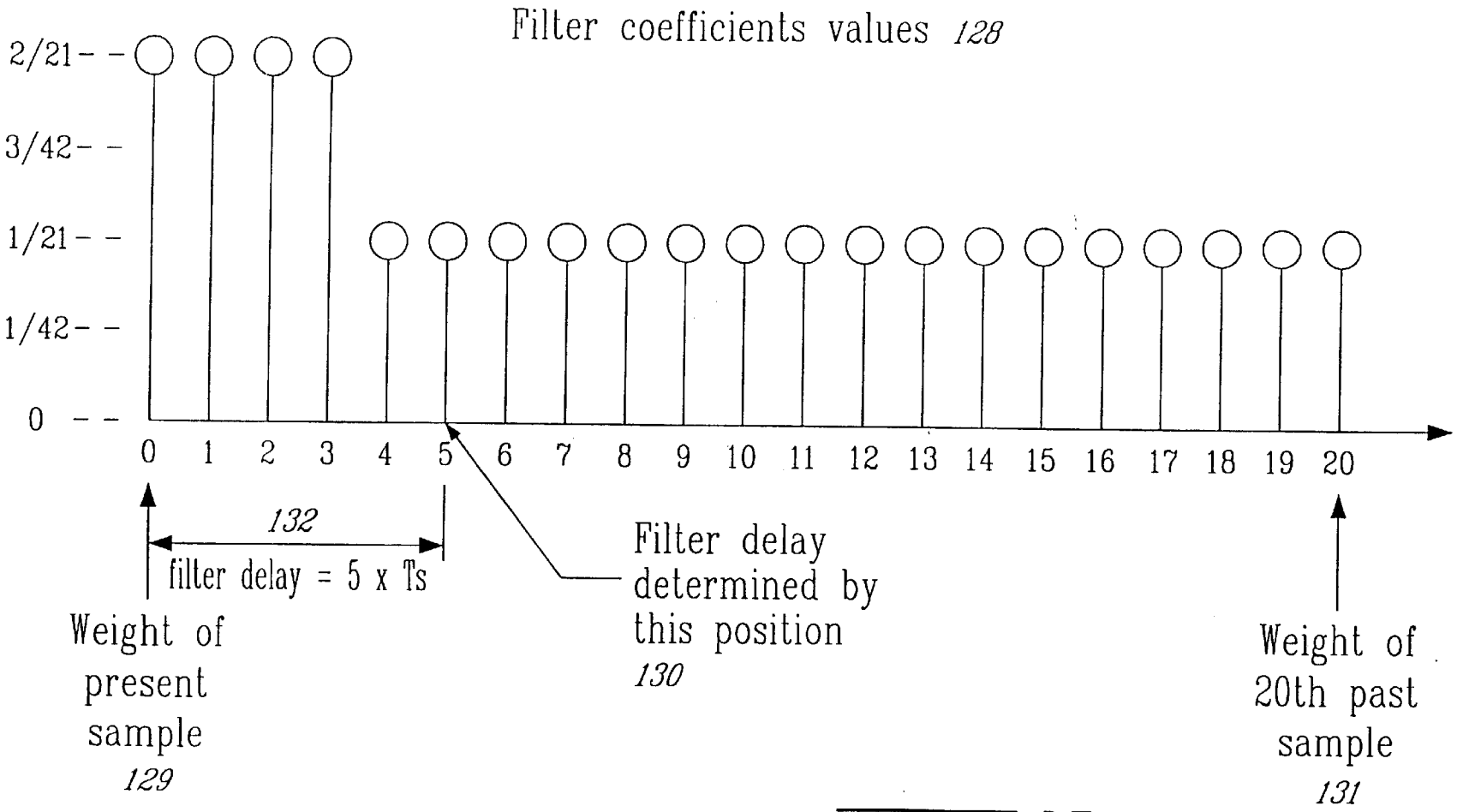
FIG. 12 is a schematic that illustrates the tendency of the filter coefficients to have stronger "present" values when the desired signal is easier to extract from the raw signal.

For all implementations of filter impulse response determination circuit 93, when the properties of the input signal S1 become favorable, the filtered signal sample S5 is produced with less delay, because the most recent elements of raw signal vector V2 are convoluted with coefficients of V1 that have a greater amplitude, as can be seen in FIG. 12. In other words, if the cross-correlation between the desired signal and the delayed raw signal shows that the desired signal is easy to extract from the raw signal, then the first filter coefficients will have a higher value. Therefore, the weight of the most recent samples is higher. In case of less favorable conditions in S1, the filter coefficients of V1 will have a more uniform amplitude distribution and therefore a greater delay, as can be seen in FIG. 11.

It is straightforward, for a person skilled in the art, to program a digital signal processor to carry out the functions identified in FIGS. 8, 9 and 10. It is also apparent to a person skilled in the art that, according to this preferred embodiment, we can achieve the optimum filtering, i.e. the shortest delay possible.

It is believed that the use of the present invention would contribute to decrease travel time and increase passenger comfort in a tilting train. For example, Amtrak's Northeast Corridor links the cities of Washington, New York and Boston. Amtrak could increase its operating speed on the Corridor to 240 km/h (150 MPH) through a combination of infrastructure improvements and the purchase of trainsets composed of tilting cars. The ride between Boston and New York which typically takes four hours and a half could be cut down to three hours.

The filtered signal sample S5 or the tilting control signal S6 are used by the master controller 19. The processing can then be performed at the master controller 19 level, at the car controller 25 level via the control network 15 or using a combination of both processing tools. To generate the tilt angle to be communicated to the hydraulic system 26, the variable filter delay has to be determined. This can be performed in parallel. Also, a sensor-to-car lag based on the train speed and distance between the car and the sensor is calculated. This lag will vary depending on the location of the car in the trainset. Then, the tilt control signal is implemented in the car controller at a time determined by the variable filter delay and the sensor-to-car lag. If the sensor-to-car lag is smaller than the variable filter delay, the tilt command to the hydraulic system 26 is given as soon as possible. If the variable filter delay is smaller than the sensor-to-car lag, it is subtracted from the sensor-to-car lag and the command delay is calculated.

As stated before, the tilt angle command delay depends on the speed of the train, the car distance from the locomotive or power car and the filter delay. It is then important for the master controller to determine the filter delay used, either in the convolution 96 or when the analog filter is chosen and use that information to set the car controller tilt angle.

The preferred embodiment was described using a lateral acceleration signal as the inertial sensor signal input. A yaw rate signal could be used without modifying the remaining circuitry. Preferably, two of these signal conditioning devices should be used in conjunction to produce a lateral acceleration tilting signal and a yaw rate tilting signal that the master controller would analyze and combine to make an overall tilting control signal.

We claim:

1. A method for filtering a train inertial sensor signal, comprising:

analyzing said sensor signal to determine at least one filtering parameter dependent on a noise content of said sensor signal to ensure a minimum filter delay and an acceptable noise level in a filtered signal; selecting filter characteristics including a filter delay using said at least one filtering parameter; filtering said sensor signal according to said filter characteristics to output a filtered sensor signal with a minimum delay.

2. The method as claimed in claim 1, wherein the train inertial sensor signal is a lateral acceleration signal.

3. The method as claimed in claim 1, wherein the train inertial sensor signal is a yaw rate signal.

4. The method as claimed in claim 1, wherein digital signal processing is used.

5. The method as claimed in claim 4 wherein the steps of analyzing, selecting and filtering comprise:

obtaining a sequence of desired signal samples from a raw digital signal from a sensor device; determining optimal values of a pre-determined number of filter coefficients using said sequence of desired signal samples and a sequence of delayed raw digital samples to obtain a filter impulse response; obtaining a raw signal vector by buffering the sequence of raw digital samples for a same delay of said number of filter coefficient; convoluting the filter impulse response with said raw signal vector to generate the filtered signal.

6. The method as claimed in claim 5, wherein said sequence of desired signal samples is obtained by using a low-pass filter with constant group delay.

7. The method as claimed in claim 5, further comprising smoothing-out of possible transient behaviors from the filtered signal.

8. The method as claimed in claim 7, wherein said smoothing-out of possible transient behaviors is done using a rate-limiting device.

9. The method as claimed in claim 5, wherein Wiener filtering is used in said determining the optimal coefficient values of the filter impulse response.

10. The method as claimed in claim 7, wherein Wiener filtering is used in said determining the optimal coefficient values of the filter impulse response.

11. The method as claimed in claim 9, wherein determining of the optimal filter coefficients values of the filter impulse response involves solving said Wiener filtering problem and comprises:

buffering both the sequence of desired signal samples and the sequence of delayed raw digital samples; cross-correlating the obtained desired signal vector and raw signal vector; auto-correlating the raw signal vector; finding the Toeplitz matrix of the auto-correlated raw signal vector; computing the values of the filter coefficients using the cross-correlated signal and the Toeplitz matrix signal.

12. The method as claimed in claim 10, wherein determining of the optimal filter coefficients values of the filter impulse response involves solving said Wiener filtering problem and comprises:

buffering both the sequence of desired signal samples and the sequence of delayed raw digital samples; cross-correlating the obtained desired signal vector and raw signal vector; auto-correlating the raw signal vector; finding the Toeplitz matrix of the auto-correlated raw signal vector; computing the values of the filter coefficients using the cross-correlated signal and the Toeplitz matrix signal.

13. The method as claimed in claim 5, wherein determining of the optimal values of filter coefficients of the filter impulse response comprises: buffering the delayed raw digital sample to obtain a delayed signal vector; filtering the delayed raw digital sample with the filter impulse response; comparing the delayed filter output with the desired signal sample to obtain an error sample; modifying the filter impulse response using feedback to maintain a minimal amplitude of the error sample; outputting the optimized filter impulse response.

14. The method as claimed in claim 7, wherein determining of the optimal values of filter coefficients of the filter impulse response comprises: buffering the delayed raw digital sample to obtain a delayed signal vector; filtering the delayed raw digital sample with the filter impulse response; comparing the delayed filter output with the desired signal sample to obtain an error sample; modifying the filter impulse response using feedback to maintain a minimal amplitude of the error sample; outputting the optimized filter impulse response.

15. A method for calculating a car controller tilt angle comprising:

determining a variable filter delay for a filtered inertial sensor signal; calculating a sensor-to-car lag based on train speed and distance between the car and the sensor; implementing the tilt control signal in said car controller at a time determined by the variable filter delay and the sensor-to-car lag.

16. A method as claimed in claim 15 wherein the sensor signal is transformed into a digital signal and the step of determining a variable filter delay comprises:

obtaining a sequence of desired signal samples from a raw digital signal from a sensor device; determining the values of a pre-determined number of filter coefficients using said sequence of desired signal samples and a sequence of delayed raw digital samples to obtain a filter impulse response, wherein said variable filter delay is determined using prior art.

17. A method as claimed in claim 15, wherein the train inertial sensor signal is a lateral acceleration signal.

18. A method as claimed in claim 15, wherein the train inertial sensor signal is a yaw rate signal.

* * * * *